US005996656A

United States Patent [19]

Fezer

[11] Patent Number: 5,996,656

[45] Date of Patent: Dec. 7, 1999

[54] APPARATUS FOR CLAMPING FLITCHES ON VERTICAL SLICERS

[75] Inventor: Carlos Alberto Fernando Fezer, Cacador, Brazil

[73] Assignee: Fezer S.A. Industrias Mecanicas, Cacador, Brazil

[21] Appl. No.: 09/179,123

[22] Filed: Oct. 26, 1998

[51] Int. Cl.[6] ..... B27C 1/00; B25B 11/00

[52] U.S. Cl. ..... 144/178; 144/162.1; 144/214; 269/21

[58] Field of Search ..... 269/20, 21; 144/162.1, 144/178, 2.01, 278.1, 214; 248/363

[56] References Cited

U.S. PATENT DOCUMENTS

| | | | |
|---|---|---|---|
| 2,303,213 | 11/1942 | Koss, Jr. | 144/178 |
| 3,441,069 | 4/1969 | Koss | 144/309 |
| 3,905,408 | 9/1975 | Hale | 144/178 |
| 4,102,372 | 7/1978 | Cremona | 144/178 |
| 5,385,184 | 1/1995 | Mellor | 269/21 |
| 5,590,700 | 1/1997 | Brand | 144/178 |
| 5,743,685 | 4/1998 | Piggott | 269/21 |

*Primary Examiner*—W. Donald Bray

*Attorney, Agent, or Firm*—Hodgson, Russ, Andrews, Woods & Goodyear, LLP

[57] ABSTRACT

An apparatus for holding flitches for slicing in a vertical slicing process. The apparatus includes a clamp having a centrally located vacuum pocket disposed between two opposed clamping dogs. The clamp provides a vacuum assisted clamp for vertical slicing of thin veneers.

15 Claims, 2 Drawing Sheets

APPARATUS FOR CLAMPING FLITCHES ON VERTICAL SLICERS

FIELD OF INVENTION

The present invention relates to machines for vertical slicing of thin sheets of veneer from flitches and more particularly to an apparatus for clamping flitches on the flitch table of a vertical slicing machine.

BACKGROUND OF THE INVENTION

Vertical slicing machines for slicing flitches to produce thin sheets of veneer are well known in the art and examples of these types of machines are shown and described in U.S. Pat. Nos. 2,303,213; 3,905,408; 4,102,372; and 3,441,069. These machines include a flitch table mounted to a support structure. The flitch table reciprocates up and down at an incline to the vertical for reasons understood by those skilled in the art. A stationary knife slices the flitch as it travels downward. Once the flitch clears the knife on the downward stroke, the knife is retracted so that the flitch does not come into contact with the knife on the way back up. Next, the cutting blade is indexed inward a distance equal to the width of the next slice. A different approach in slicing is to have the stationary knife slicing as the flitch travels upward. On the downstroke, the knife is retracted to avoid touching the flitch. Before it starts moving upwards again it is indexed to the predetermined thickness. The flitch is typically held to the flitch table by a set of clamping dogs. In this manner the flitch is securely held while it travels up and down and engages the cutting blade. Accordingly, the flitch can be trimmed down only to a certain residual width. At this point, further slicing would cause contact between the cutting blade and the clamping dogs or other clamping apparatus which would result in damage to the blade. The systems for holding the flitches in place on the vertical machines include mechanical clamps which move to secure the flitch by means of rotating screws driven by electric motors or by means of hydraulic cylinders. Also, there are flitch tables which hold the flitches exclusively by vacuum generated through vacuum ports disposed throughout the entire surface of the table.

The mechanical clamps, motor driven or hydraulic, are capable of holding any type and shape of flitch. A combination of groups of clamps with different heights, ranging from 150 mm to 10 mm, allow the slicing of the flitches to a residual board of 12 mm. As described above, additional slicing would cause damage to the blade from contact with the clamping mechanisms. These mechanical systems can present a problem for the slicing operation. When the flitch becomes thin towards the end of the cutting, it starts to deflect away from the table, especially on wider flitches, which results in variations in the thickness of the veneer. The variations result because if the flitch is deflecting away, then it is extending further across the blade than is intended, and therefore the veneer will be too thick.

The vacuum flitch tables have the disadvantages that certain shapes or sizes of flitches cannot be safely clamped, and dropping the flitch during the cutting process can result in damages to the machine. Accordingly, this limits the use of the vertical slicing machine in some circumstances. Another approach has been to install a number of vacuum pockets in fixed positions along the flitch table in combination with mechanical systems. A drawback with this arrangement is the fact that the flitch has to be loaded exactly at the position where the pockets are located, otherwise, if the pocket is not covered, the vacuum ports will be open to the atmosphere and the vacuum will not operate on the flitch. It is relatively difficult to load the flitches properly with the typical manual loading systems used throughout the industry because the operators have to be very careful not to incline or move the flitches vertically out of the vacuum area. Also, different qualities of woods require a different cutting angle, and when the vacuum pockets are fixed on the table, it is necessary to move the setting in order to accommodate the alternate cutting angle which takes time.

Accordingly, what is needed is an apparatus for clamping flitches to flitch tables teat overcomes the drawbacks discussed above by combining the vacuum pockets with the hydraulic clamps.

SUMMARY OF THE INVENTION

The present invention overcomes the drawbacks discussed above by providing an apparatus for clamping flitches to flitch tables that combines the vacuum pockets with the mechanical clamps. The present invention provides an apparatus having a pair of clamping dogs disposed on opposite sides of a vacuum pocket. The vacuum pocket is bordered by a soft resilient material that abuts with the back of the flitch to form an air tight seal. The vacuum pocket is disposed inside a support member and extends for a majority of the width of the support member. The clamping dogs are actuated by drive members that can be controlled by either hydraulics or mechanical screws. The combination of the clamping dogs and the large central opening securely attaches the flitch. The vacuum pockets are integral with the clamping apparatus rather than the usual method of fixing the vacuum pockets on the reciprocating table to overcome the drawbacks discussed above. The vacuum pockets are installed on carriers that hold the clamps. The vacuum pockets are normally retracted so that the vacuum seal does not rub on the flitch as it is being installed. Once the mechanical clamp reaches the end of its travel, a pneumatic cylinder actuates to advance the vacuum pocket toward the flitch and bring the vacuum seal into contact with the wood. After a short time delay, the vacuum system is activated to create the holding force. When the slicing process is finished, the system will allow air to break the vacuum, and the pneumatic cylinders will be deactivated to retract the vacuum pocket from the remaining sliced board. Next, the hydraulic cylinders will open the clamp to allow the next flitch to be loaded and the process to begin again.

Accordingly, it is an object of the present invention to provide a combination Mechanical and vacuum operated clamping mechanism for clamping a flitch to a flitch table in a vertical slicing imachine.

DESCRIPTION OF THE PREFERRED EMBODIMENT

The present invention provides a flitch holding apparatus 10 suitable for use in a vertical slicing machine of the type shown and described in U.S. Pat. No. 2,303,213 and other types of vertical slicers. These vertical slicing machines include a flitch table that slides up and down in reciprocating fashion. Although the slicer may slice on the upward or downward stroke, the downward slicing system will be discussed for clarity. The flitch table slides at an incline to vertical for reasons known by those skilled in the art. The flitch table engages a stationary cutting blade on the downward stroke. Once the flitch passes the blade, the flitch reverses direction, and the cutting blade is retracted to provide clearance. After the upward stroke, the cutting blade is indexed inward a distance equal to the width of one slice and then the flitch comes down and engages with the blade for the next slice.

Figure 2:
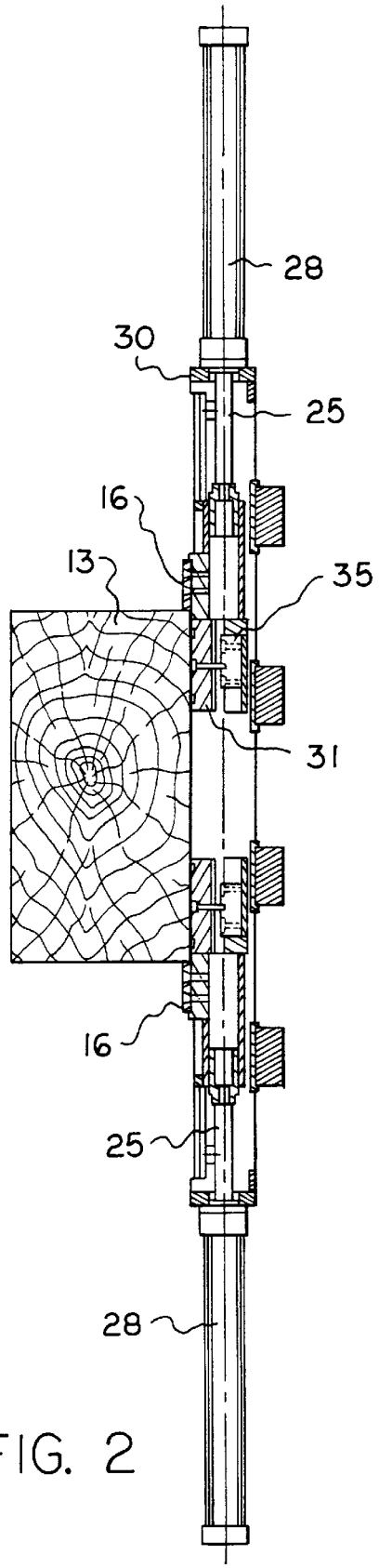
FIG. 2 is a side elevation of the apparatus of the present invention.
Figure 1:
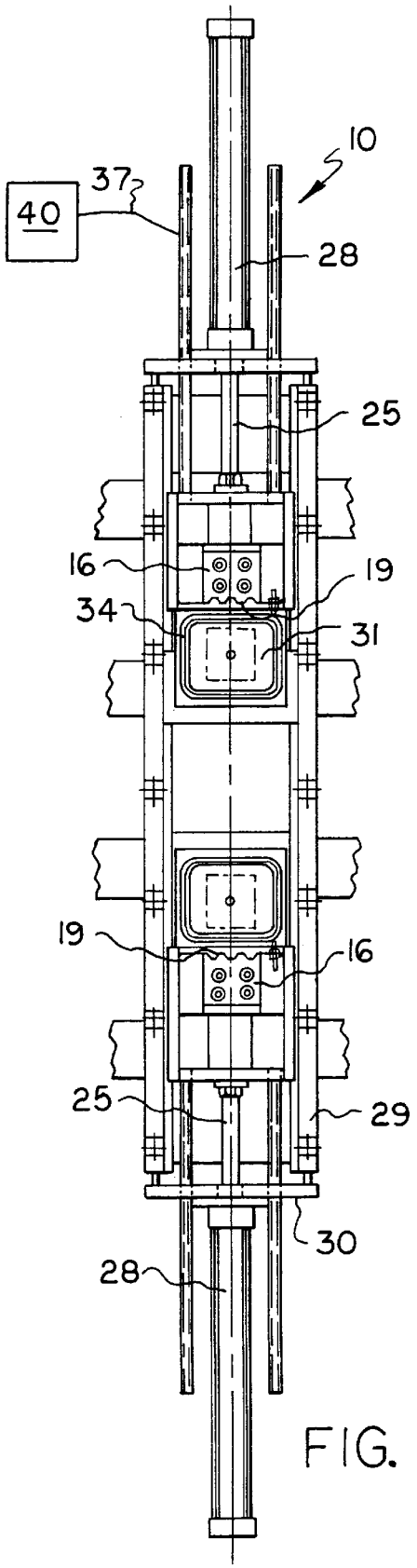
FIG. 1 is a plan view of the apparatus of the present invention.
Figure 3:
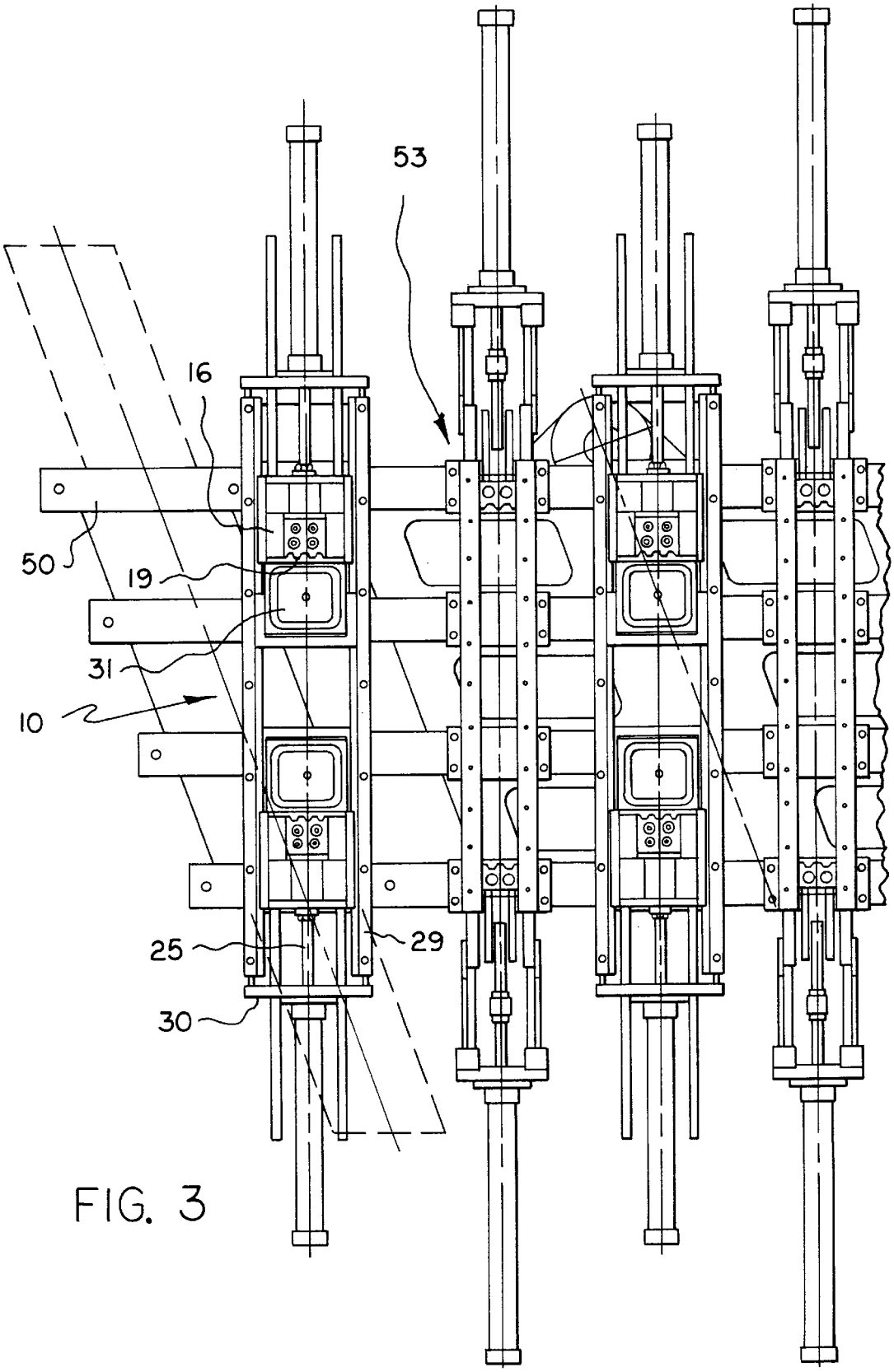
FIG. 3 is a partial front elevational view of a flitch table equipped with the apparatus of the present invention.

Referring to FIGS. 1 and 2, the apparatus 10 of the present invention provides an improved structure for attaching a flitch 13 (shown in FIG. 2) to a reciprocating flitch table (shown in FIG. 3).

The apparatus 10 includes a pair of opposed clamping dogs 16. The clamping dogs 16 are preferably formed with a set of teeth 19. The teeth 19 provide for gripping the flitch 13. The clamping dogs 16 are preferably constructed of a strong durable material such as steel. They are preferably bolted to the ends of drive members 25. The drive members 25 preferably comprise connecting rods or shafts that are connected to hydraulic cylinders 28. The drive members 25 and hydraulic cylinders 28 are preferably mounted to a support member 29 having a frame 30 that mounts directly to the flitch table. Other mechanisms for applying a force to the drive members 25 could also be used in the present invention such as mechanical screws, pneumatic cylinders, and the like. The force of the drive members 25 causes the opposed clamping dogs 16 to move toward one another like a set of jaws to clamp down on the flitch 13.

The clamping dogs 16 are disposed on opposite sides of a vacuum pockets 31. The vacuum pockets 31 preferably extends across a majority of the width of the support member 29. The vacuum pocket 31 is bordered by a gasket 34 that is preferably formed out of a soft, resilient material such that once a vacuum is drawn on the vacuum pocket 31, the gasket 34 forms an air tight seal with the back of the flitch 13. The vacuum pockets 31 are preferably installed on the support member 29 such that they are capable of being retracted by means of a pneumatic cylinder 35. The vacuum pockets 31 are retractable such that the gaskets 34 do not rub against the flitches 13 while they are being loaded.

The apparatus 10 of the present invention can be used with any existing slicing machine starting with lengths of approximately 2.9 m to 5.4 m useful length. Several of the apparatus 10 would typically be used for long flitches 13. The combination of the clamping dogs 16 and the vacuum pockets 31 enables the clamping dogs 16 to be installed as low as 6 mm above the reference surface of the flitch table.

The vacuum pockets 31 can be connected to vacuum lines 37 that connect to a vacuum system 40. The vacuum system 40 can be any type of pumping system capable of drawing a vacuum on the vacuum pocket 31. Some examples include screw type vacuum systems 40 and the like. Auxiliary valves (not shown) can be provided to shut off the vacuum to some of the vacuum pockets 31 in the case of shorter flitches 13.

In FIG. 3, a reciprocating flitch table 50 is shown having a plurality of the apparatus 10 disposed from side to side. Mechanical clamps 53 are disposed between the apparatus 10.

In operation, once the mechanical clamping dogs 16 reach the end of their travel, the vacuum pocket 31 is moved forward by the pneumatic cylinder 35, which is supplied with air through line 36, via an electric operated valve, until the gasket 34 comes into contact with the flitch 13. After a short time delay, the vacuum system 40 will be actuated and a vacuum will be drawn on the vacuum pocket 31 to help hold the flitch 13 in position during the vertical slicing process. When the vertical slicing process is completed, a valve releases air into the system to break the vacuum. Next, the pneumatic cylinder 35 is released of pressure to allow the vacuum pocket 31 to move away from the remaining sliced board. Finally, the hydraulic cylinders 28 that operate the clamping dogs 16 return to their resting position. At this point the system is ready to be loaded with a new flitch 13 to begin the slicing process again.

The present invention offers several advantages including the ability to slice the flitches 13 to a smaller residual board. Also, the present invention enables all sizes and shapes of flitches 13 to be safely clamped. Further, the present invention eliminates the problems associated with the tendency of the flitch to deflect away from the table when it becomes thin toward the end of the slicing.

Another advantage is that, because the vacuum pockets are integral with and form a part of the clamp, the vacuum pockets are always in the correct position when the flitches are loaded into the clamps.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed:

1. An apparatus for clamping a flitch to a flitch table, comprising:

a support member mounted to a flitch table and having a frame;

a pair of opposed clamping members mounted on the support member and disposed inside the frame such that they are capable of moving relative to the flitch table, the clamping members having mechanical clamps and a vacuum opening defining a space therein and disposed adjacent to the clamps; and, a vacuum source capable of reducing the pressure inside the space;

wherein the mechanical clamps and the vacuum opening both are capable of moving relative to the flitch table.

2. The apparatus of claim 1, wherein the clamping members are disposed on opposite sides of the space.

3. The apparatus of claim 1, further comprising a pair of drive members attached to the clamping members.

4. The apparatus of claim 3, wherein the drive members are driven by a hydraulic cylinder.

5. The apparatus of claim 3, wherein the drive members are driven by a screw.

6. The apparatus of claim 1, wherein the opening is bordered by a gasket.

7. An apparatus for clamping a flitch to a flitch table, comprising:

a support member mounted to a flitch table and capable of movement relative to the flitch table and having an opening defining a space therein, the space being capable of being retracted into the support member;

a pair of opposed clamping members mounted on the support member; and, a vacuum source capable of reducing the pressure inside the space.

8. An apparatus for clamping a flitch to a flitch table, comprising:

a plurality of support members mounted to the flitch table and having frames;

a pair of opposed clamping members disposed inside each frame such that they are capable of moving relative to the flitch table, the clamping members having clamping dogs and a vacuum opening defining a space therein disposed adjacent to the clamping dogs;

a pair of drive members connected to each of the clamping members; and a vacuum source capable of reducing the pressure inside the vacuum openings in the clamping members.

9. The apparatus of claim 8, wherein the drive members are driven by a hydraulic cylinder.

10. The apparatus of claim 8, wherein the drive members are driven by a screw.

11. An apparatus for clamping a flitch to a flitch table, comprising:

a plurality of support members mounted to the flitch table and having an opening defining a space therein, the opening bordered by a gasket and sized to be capable of forming a vacuum pocket behind the flitch, the vacuum pocket capable of being retracted into the support member;

a pair of opposed clamping dogs mounted to each support member on opposite sides of the opening, the clamping dogs capable of moving relative to one another;

a pair of drive members connected to the clamping dogs; and, a vacuum source capable of reducing the pressure inside the openings in the support member.

12. The apparatus of claim 11, further comprising a hydraulic cylinder mounted on the support member such that the hydraulic cylinder is capable of moving the vacuum pocket relative to the flitch.

13. The apparatus of claim 11, wherein the vacuum pocket is capable of being retracted into the support member such that the gasket does not contact the flitch until it is secured in position by the clamping dogs.

14. The apparatus of claim 13, wherein the vacuum source is energized once the vacuum pocket is moved forward into engagement with the flitch.

15. An apparatus for clamping a flitch to a flitch table, comprising:

a support member mounted to a flitch table and capable of movement relative to the flitch table and having an opening defining a space therein, the opening being bordered by a gasket;

a pair of opposed clamping members mounted on the support member;

a vacuum source capable of reducing the pressure inside the space; and, wherein the space is capable of being retracted into the support member such that the gasket does not contact the flitch until it is secured in position by the clamping members.

* * * * *